US012129440B2

(12) United States Patent
Gaouyat

(10) Patent No.: US 12,129,440 B2
(45) Date of Patent: Oct. 29, 2024

(54) JET FUEL COMPOSITION AND METHOD FOR PRODUCING A JET FUEL COMPOSITION

(71) Applicant: TotalEnergies OneTech, Courbevoie (FR)

(72) Inventor: Elodie Gaouyat, Serres-Castet (FR)

(73) Assignee: TotalEnergies One Tech, Courbevoie (FR)

( * ) Notice: Subject to any disclaimer, the term of this patent is extended or adjusted under 35 U.S.C. 154(b) by 0 days.

(21) Appl. No.: 18/014,498

(22) PCT Filed: Jul. 6, 2021

(86) PCT No.: PCT/EP2021/068703
§ 371 (c)(1),
(2) Date: Jan. 5, 2023

(87) PCT Pub. No.: WO2022/008534
PCT Pub. Date: Jan. 13, 2022

(65) Prior Publication Data

US 2023/0313061 A1 Oct. 5, 2023

(30) Foreign Application Priority Data

Jul. 8, 2020 (EP) ..... 20305785

(51) Int. Cl.
*C10L 1/04* (2006.01)
*C10L 1/02* (2006.01)

(52) U.S. Cl.
CPC ..... *C10L 1/04* (2013.01); *C10L 1/02* (2013.01); *C10L 2200/043* (2013.01);
(Continued)

(58) Field of Classification Search
CPC ..... C10M 103/00; C10M 103/02; C10M 103/06; C10M 105/70; C10M 107/02;
(Continued)

(56) References Cited

U.S. PATENT DOCUMENTS

2008/0244962 A1* 10/2008 Abhari ..... C10L 3/12 208/15
2020/0190421 A1* 6/2020 Kuronen ..... C10L 1/1616

OTHER PUBLICATIONS

International Search Report of PCT/EP2021/068703 dated Aug. 3, 2021 [PCT/ISA/210].
(Continued)

*Primary Examiner* — Ellen M McAvoy
*Assistant Examiner* — Chantel Graham
(74) *Attorney, Agent, or Firm* — Sughrue Mion, PLLC

(57) ABSTRACT

The invention relates to jet fuel compositions, in particular jet fuel compositions having improved cold properties, and more particularly improved freezing point with respect to theoretical linear behavior, which are mixtures of jet fuel from petroleum origin and renewable component. To this effect, a jet fuel composition comprising a petroleum derived jet fuel component and a renewable component consisting of hydroprocessed esters and fatty acids is proposed, wherein the jet fuel composition contains 1 to 50 vol % of the renewable component and has a freezing point of −40° C. or below, preferably of −47° C. and below, and the petroleum derived jet fuel component has a content of C9-C12 normal paraffins from 17 wt % to 30 wt %.

17 Claims, 2 Drawing Sheets

(52) U.S. Cl.
CPC ... *C10L 2200/0484* (2013.01); *C10L 2270/04* (2013.01); *C10L 2290/24* (2013.01)

(58) Field of Classification Search
CPC ..... C10M 107/20; C10M 107/32; C10M 107/38; C10M 107/40; C10M 107/50; C10M 125/00; C10M 125/02; C10M 125/10; C10M 125/26; C10M 125/28; C10M 145/40; C10M 169/04; C10M 169/044; C10M 2201/00; C10M 2201/003; C10M 2201/0403; C10M 2201/041; C10M 2201/0413; C10M 2201/042; C10M 2201/0423; C10M 2201/0433; C10M 2201/06; C10M 2201/0603; C10M 2201/061; C10M 2201/0613; C10M 2201/062; C10M 2201/0623; C10M 2201/065; C10M 2201/0653; C10M 2201/066; C10M 2201/0663; C10M 2201/0803; C10M 2201/0853; C10M 2201/0863; C10M 2201/087; C10M 2201/0873; C10M 2201/10; C10M 2201/1006; C10M 2201/102; C10M 2201/1023; C10M 2201/1033; C10M 2201/105; C10M 2201/1053; C10M 2201/12; C10M 2201/123; C10M 2201/16; C10M 2201/18; C10M 2203/06; C10M 2205/0206; C10M 2207/08; C10M 2209/00; C10M 2209/003; C10M 2209/02; C10M 2209/10; C10M 2209/1013; C10M 2209/102; C10M 2209/1023; C10M 2209/12; C10M 2211/06; C10M 2213/00; C10M 2213/02; C10M 2213/023; C10M 2213/043; C10M 2213/0606; C10M 2213/062; C10M 2213/0623; C10M 2215/2203; C10M 2215/222; C10M 2215/2265; C10M 2215/305; C10M 2217/003; C10M 2217/022; C10M 2217/042; C10M 2217/043; C10M 2217/044; C10M 2217/045; C10M 2229/025; C10M 2229/0405; C10M 2229/0415; C10M 2229/0425; C10M 2229/0435; C10M 2229/0445; C10M 2229/0455; C10M 2229/0465; C10M 2229/0475; C10M 2229/0485; C10M 2229/0505; C10M 2229/0515; C10M 2229/0525; C10M 2229/0535; C10M 2229/0545; C10L 1/02; C10L 1/04; C10L 2200/043; C10L 2200/0484; C10L 2270/04; C10L 2290/24
See application file for complete search history.

(56) References Cited

OTHER PUBLICATIONS

Written Opinion of PCT/EP2021/068703 dated Aug. 3, 2021 [PCT/ISA/237].

* cited by examiner

JET FUEL COMPOSITION AND METHOD FOR PRODUCING A JET FUEL COMPOSITION

CROSS REFERENCE TO RELATED APPLICATIONS

This application is a National Stage of International Application No. PCT/EP2021/068703 filed Jul. 6, 2021, claiming priority based on European Patent Application No. 20305785.6 filed Jul. 8, 2020, the entire disclosures of which are incorporated by reference herein.

BACKGROUND

Several standards specify the requirements for aviation turbine fuels, also called jet fuels, intended for use in aircraft turbine engines, including the requirements for jet fuels containing synthetic components, in particular from renewable origin such as hydroprocessed esters and fatty acids (HEFA).

The freeze point of a jet fuel composition is an important factor in determining whether it is suitable for operation under low temperature conditions.

FR3062391 discloses a diesel fuel blend having enhanced cold properties. The diesel fuel blend comprises a blend of a renewable fuel component and a mineral middle distillate fuel component in which the renewable fuel component and mineral middle distillate fuel component are present in a ratio of amounts by volume of from 10:90 to 90:10 and the diesel fuel blend contains 10-25 wt % n-paraffins in the C14-C20 range and an amount of iso-paraffins in the C14-C20 range such that the ratio of the sum of wt % amounts of iso-paraffins in the C14-C20 range to the sum of wt % amounts of n-paraffins in the C14-C20 range is less than 2.2. This document does not disclose jet fuel compositions.

EP1664249B1 discloses a fuel composition prepared by blending petroleum derived kerosene base fuels and Fischer-Tropsch derived kerosene base fuels. The Fischer-Tropsch derived kerosene base fuel has boiling points within the range 130 to 300° C., a density from 730 to 770 kg/m$^3$ at 15° C. and consists of 90 wt % or more of paraffinic components. It contains normal and iso-paraffins in a weight ratio of greater than 1:1. The purpose of addition of this Fischer-Tropsch derived kerosene base fuel, in an amount of 0.1 to 81 vol % in the fuel composition, is to reduce the freeze point of the fuel composition below that of the petroleum derived kerosene fuel.

WO2018224730A1 discloses a fuel composition comprising a petroleum derived jet fuel component and a renewable jet fuel component, wherein the fuel composition has a freezing point of −40° C. or below and a cetane number more than 40. The renewable jet fuel component is a hydrotreated middle distillate having a distillation range from 145° C. to 315° C. The petroleum derived jet fuel component has a freezing point between −47° C. and −60° C. and the difference between the freezing point of the renewable jet fuel component and the freezing point of the petroleum derived jet fuel component is less than 25° C. The renewable jet fuel component has an iso-paraffin content of more than 70 wt %, more than 70 wt % of C15 to C18 paraffins, less than 20 wt % of paraffins smaller than C15 paraffins, less than 10 wt % of paraffins larger than C18 paraffins.

US20140187827A1 describes a method of making a jet fuel composition comprising a mineral-based kero/jet-type distillate component having an initial boiling point of at least 100° C. and a deoxygenated and dewaxed renewable component derived from triglycerides and/or fatty acids having an iso-paraffin to normal paraffin ratio from 2:1 to 6:1 and an aromatics content less than about 1 vol %. The jet fuel composition comprises from 3 vol % to 25 vol % of the renewable component.

WO2017/197017A1 discloses compositions that include at least 98 wt % n-paraffins which may be suitable for use as a diesel fuel, aviation fuel, jet fuel blendstock, a blendstock to reduce the cloud point of a diesel fuel. The composition includes at least 98 wt % C7-C12 n-paraffins, where at least 10 wt % of the composition includes n-decane, at least 20 wt % of the composition includes n-dodecane, and at least 75 wt % of the composition includes even carbon number paraffins.

However, cold properties of a jet fuel composition comprising a petroleum derived jet fuel component and more particularly the freezing point is not improved by addition of a renewable component for any petroleum derived jet fuel component with respect to the calculated freezing point obtained by a linear relation.

SUMMARY

The present invention relates to jet fuel compositions, in particular jet fuel compositions having improved cold properties, and more particularly improved freezing point with respect to theoretical linear behavior, which are mixtures of jet fuel from petroleum origin and renewable component.

An improvement of cold properties and more specifically of the freezing point of the fuel composition of the invention, is obtained by mixing a jet fuel from petroleum origin with a particular normal paraffins content to 1 to 50 vol % of a renewable component consisting of hydroprocessed esters and fatty acids.

Definitions

A petroleum derived jet fuel component consists predominantly of refined hydrocarbons and trace levels of materials that are not hydrocarbons including oxygenates, organosulfur and nitrogenous compound. The refined hydrocarbons are derived from conventional sources including crude oil, natural gas liquid condensates, heavy oil, shale oil and oil sands.

Hydroprocessed esters and fatty acids consist predominantly of mono-, di- and triglycerides, free fatty acids and fatty acid esters, which have been hydroprocessed to remove essentially oxygen.

DETAILED DESCRIPTION

According to a first aspect, a jet fuel composition is provided comprising a petroleum derived jet fuel component and a renewable component consisting of hydroprocessed esters and fatty acids, wherein the jet fuel composition contains 1 to 50 vol % of the renewable component and has a freezing point of −40° C. or below, preferably of −47° C. and below, and the petroleum derived jet fuel component has a content of C9-C12 normal paraffins from 17 wt % to 30 wt % and wherein the freezing point of the jet fuel composition is lower than a theoretical freezing point calculated from a linear relation.

The jet fuel composition of the invention has a freezing point below a theoretical freezing point calculated from a linear relation, and optionally below the freezing point of each component. This theoretical freezing point is obtained in a usual way by pondering the freezing point of each compound by its content and addition of the results.

The petroleum derived jet fuel component may have a content of C9-C12 normal paraffins from 17 wt % to 30 wt %, preferably from 17 wt % to 25 wt %.

In particular, the petroleum derived jet fuel component may have a content of paraffins lower than C9 less than 10 wt %, preferably less than 5 wt % and a content of paraffins higher than C12 less than 20 wt % preferably less than 18% wt. The content of paraffins lower than C9 may be from 0 to 5 or 10 wt %, or from 0.5 to 5 or 10 wt %. The content of paraffins higher than C12 may be from 0 to 18 or 20 wt % or from 4 to 18 or 20 wt % or within any of these limits.

In general, the petroleum derived jet fuel component may have a total content of paraffins from 40 to 55 wt %, preferably from 40 to 50 wt %.

In general, the petroleum derived jet fuel component may preferably be a petroleum derived jet fuel that complies with the requirements for jet fuels as specified in the following standards: DefStan 91-091 Issue 11, ASTM D1655 January 2018. In particular, this petroleum derived jet fuel component may comply with the requirements for a Jet A1 or a Jet A.

In general, the petroleum derived jet fuel component may have a freezing point of −40° C. or below, preferably of −47° C. or below.

In one embodiment, the content of renewable component in the jet fuel composition may be from 5 to 50 vol % or from 10 to 50 vol % or within any of these limits.

In general, the renewable component may include, or consist of, hydroprocessed synthesized paraffinic kerosine wholly derived from paraffins derived from hydrogenation and deoxygenation of fatty acid esters and free fatty acids and subsequent processing of the product including hydrocracking, or hydroisomerization, or isomerization, or fraction, or a combination thereof, and may include other conventional refinery processes. In other words, the renewable component is produced from hydroprocessed esters and fatty acids. Advantageously, the renewable component may comply with the requirements of synthesized paraffinic kerosine specified in Annex 2 of ASTM D7566 March 2019.

The renewable component may be produced from natural occurring oil(s), in particular from the above mentioned treatments of such natural occurring oil(s).

A natural occurring oil is defined as an oil of biomass origin, and do not contain or consist of any mineral oil. In the description "natural occurring oil(s)" designates indifferently oil, fat and their mixtures.

Said natural occurring oil(s) may contain one or several oils chosen among vegetable oil, animal fat, preferentially inedible highly saturated oils, waste oils, by-products of the refining of vegetable oil(s) or of animal oil(s) containing free fatty acids, tall oils, and oil produced by bacteria, yeast, algae, prokaryotes or eukaryotes.

Suitable vegetable oils are for example palm oil, palm kernels oil, soy oils, soybean oil, rapeseed (colza or canola) oil, sunflower oil, linseed oil, rice bran oil, maize (corn) oil, olive oil, castor oil, sesame oil, pine oil, peanut oil, castor oil, mustard oil, carinata oil, palm kernel oil, hempseed oil, coconut oil, babasu oil, cottonseed oil, linola oil, jatropha oil.

Animal fats include tallow, lard, grease (yellow and brown grease), fish oil/fat, butterfat, milk fats.

By-products of the refining of vegetable oils or animal oils are by-products containing free fatty acids that are removed from the crude fats and oils by neutralisation or vacuum or steam distillation. Typical example is PFAD (palm free acid distillate).

Waste oils include waste cooking oils (waste food oil) and oils recovered from residual water, such as trap and drain greases/oils, gutter oils, sewage oils, for example from water purification plants, and waste fat from the food industry.

Tall oils, including crude tall oils, distillate tall oils (DTO) and tall oil fatty acids (TOFA), preferably DTO and TOFA, can also be used in the present invention.

Tall oil, or otherwise known as tallol, is a liquid by-product of the Kraft process for processing wood, for isolating on the one hand the wood pulp useful in the papermaking industry, and on the other hand tall oil. Tall oil is essentially obtained when conifers are used in the Kraft process. After treating wood chips with sodium sulfide in aqueous solution, the tall oil isolated is alkaline. The latter is then acidified with sulfuric acid to produce crude tall oil.

The natural occurring oil(s) used in the present invention also include oils produced by microorganisms, either natural or genetically modified microorganisms, such as bacteria, yeast, algae, prokaryotes or eukaryotes. In particular such oils can be recovered by mechanical or chemical extraction well known methods. The renewable jet fuel component may have one or more of the following features:

- a freezing point below −30° C., preferably below −40° C.
- a density at 15° C. between 730 and 772 kg/m$^3$.

In combination or not with any of one or several of the above physical properties, the renewable component may have one or more of the following features:

- an isoparaffin content of 80 wt % or more, for example from 80 wt % to 95 or 99 wt %,
- an iso-paraffins to normal paraffins ratio of at least 6.5:1, for example from 6.5:1 to 11,
- a C9-C17 paraffins content of at least 80 wt %, for example from 80 to 99 wt %,
- a C9-C17 iso-paraffins content of at least 75 wt %, for example from 75 to 90 wt %,
- a content of paraffins lower than C15 from 45 wt % to 90 wt %,
- a C9-C12 n-paraffins content of less than 20 wt %, for example from 2 to 20 wt %, from 2 to 15 wt % or from 2 to 10%, in combination or not with any or all of the above features and their examples.

The jet fuel composition of the invention may have a normal paraffins content of C9-C12 paraffins from 10 to 20 wt % and a total normal paraffins content from 15 to 30 wt %.

Advantageously, the jet fuel composition of the invention may comply with Jet A or Jet A1 requirements as defined in ASTM D7566 March 2019 or into DefStan 91-091 Issue 11 which refers to ASTM D7566. In particular, the content of renewable component in the jet fuel composition may be chosen such that the jet fuel composition complies with these requirements.

According to a second aspect, the invention claims a method for producing a jet fuel composition, wherein the method comprises mixing a petroleum derived jet fuel component and a renewable component consisting of hydroprocessed esters and fatty acids to obtain a jet fuel composition containing 1 to 50 vol % of the renewable component and having a freezing point of −40° C. or below, preferably of −47° C. or below, wherein the petroleum derived jet fuel component has a content of C9-C12 normal paraffins from 17 wt % to 30 wt % and wherein the freezing point of the jet fuel composition is lower than a theoretical freezing point calculated from a linear relation.

The petroleum derived jet fuel component may be as previously described with respect to the jet fuel composition.

The renewable component may be as previously described with respect to the jet fuel composition.

The invention also concerns the use of a petroleum derived jet fuel component having a content of C9-C12 normal paraffins from 17 wt % to 30 wt % for preparing a jet fuel composition from a mixture of a petroleum derived jet fuel component and a renewable component consisting of hydroprocessed esters and fatty acids, such jet fuel composition having a freezing point of −40° C. or below, preferably of −47° C. or below, said freezing point being lower than a theoretical freezing point calculated from a linear relation.

The invention therefore also relates to a method for obtaining a jet fuel composition from a mixture of a petroleum derived jet fuel component and a renewable component consisting of hydroprocessed esters and fatty acids, such jet fuel composition having a freezing point of −40° C. or below, preferably of −47° C. or below, said freezing point being lower than a theoretical freezing point calculated from a linear relation, wherein the renewable component is mixed in a content from 1 to 50 vol % with a petroleum derived jet fuel component having a content of C9-C12 normal paraffins from 17 wt % to 30 wt %. The petroleum derived jet fuel component and the renewable component may each be as previously described with respect to the jet fuel composition.

DESCRIPTION OF THE DRAWINGS

The invention will be better understood with reference to the figures, which show exemplary embodiments of the invention.

EXAMPLES

Figure 1:
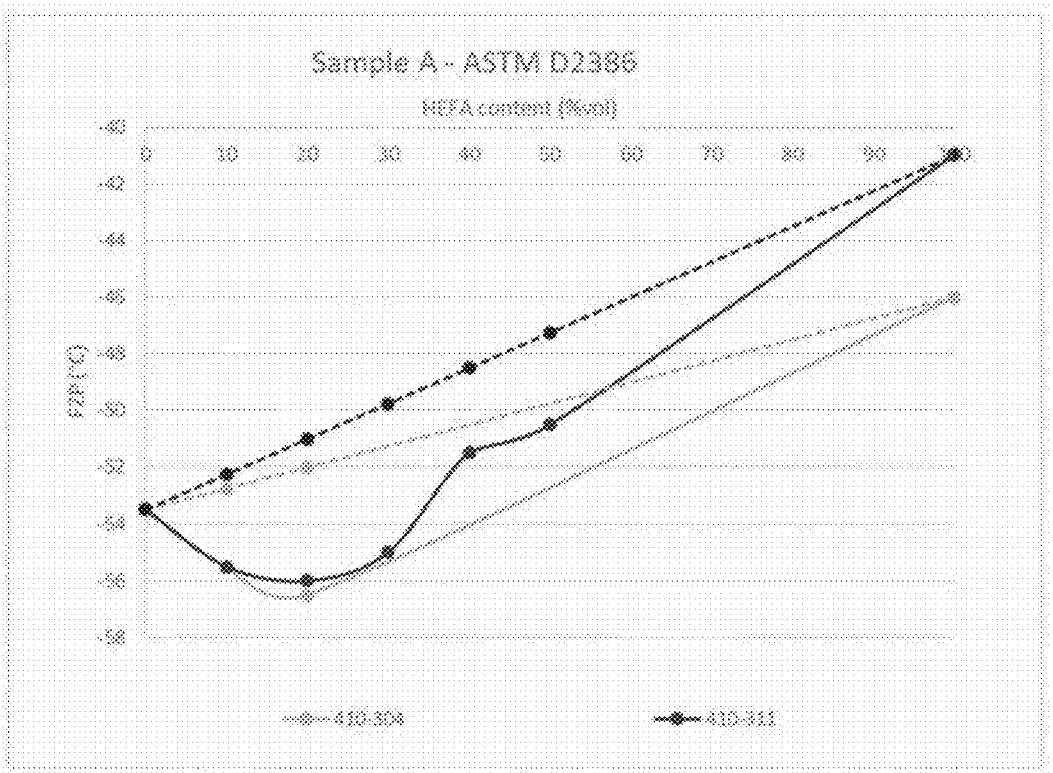
FIG. 1 is a graph comparing the measured freezing points and linear calculation of the freezing point (proportional to the volume content of the renewable jet component) for mixtures of a petroleum jet component according to the invention and several renewable jet components at different compositions. The measured freezing point is according to ASTM D2386-19.

Several petroleum jet fuel components have been mixed with different renewable components.

Table 1 resumes the physical properties and composition of the petroleum jet fuel components and table 2 resumes the physical properties and composition of the renewable components.

The compositions were determined by a GCxGC method.

Petroleum jet fuel components A and B have n-C9-C12 contents according to the invention. This is not the case of jet fuel components C, D which are used to prepare comparative examples.

The freezing points have been measured using two standard methods.

The first method is a manual one which is the usual reference method and corresponds to ASTM D2386-19.

The second method is an automatic one and corresponds to ASTM D7153-15e1. It has been implemented with a PAC ISL apparatus.

The reproducibility "R" of these freezing point measurement methods are the following:

ASTM D2386-19: R=2.5

ASTM D7153-15e1: R=0.9

TABLE 1

Physical properties and composition of petroleum jet fuel components

| | 408-6643 Sample A | 408-6628 Sample B | 408-6618 Sample C | 408-6657 Sample D |
|---|---|---|---|---|
| Freezing point (° C.) ASTM D2386-19 | −53.5 | −59.0 | −51.5 | −50.4 |
| Freezing point (° C.) ASTM D7153-15e1 | −52.8 | −59.8 | −50.6 | −50.4 |
| Density at 15° C. (Kg/m$^3$) ASTM D1298-12b(2017) | 789.4 | 797.6 | 799.0 | 802.3 |
| Composition (wt %) | | | | |
| n- C6 | 0.02 | 0.01 | 0.01 | 0.01 |
| iso- C7 | 0.07 | 0.24 | 0.19 | 0.13 |
| n- C7 | 0.29 | 0.28 | 0.19 | 0.21 |
| iso- C8 | 1.05 | 0.69 | 0.46 | 0.57 |
| n- C8 | 0.93 | 0.86 | 0.71 | 0.74 |
| iso- C9 | 2.56 | 1.61 | 2.41 | 2.15 |
| n- C9 | 4.62 | 1.94 | 3.56 | 2.86 |
| iso- C10 | 4.49 | 4.81 | 6.00 | 5.65 |
| n- C10 | 5.92 | 4.69 | 4.60 | 4.48 |
| iso- C11 | 3.05 | 6.61 | 4.58 | 4.38 |
| n- C11 | 5.87 | 6.18 | 4.14 | 3.80 |
| iso- C12 | 2.75 | 5.00 | 3.97 | 4.05 |
| n- C12 | 4.25 | 4.42 | 3.54 | 3.30 |
| iso- C13 | 1.81 | 3.40 | 3.10 | 3.17 |
| n- C13 | 3.19 | 2.08 | 2.69 | 2.45 |
| iso- C14 | 0.78 | 1.66 | 2.52 | 2.70 |
| n- C14 | 1.73 | 0.40 | 1.86 | 1.73 |
| iso- C15 | 0.33 | 0.33 | 2.19 | 2.34 |
| n- C15 | 0.51 | 0.04 | 0.95 | 0.97 |
| iso- C16 | 0.21 | | 0.48 | 0.62 |
| n- C16 | 0.12 | 0.01 | 0.31 | 0.45 |
| iso- C17 | 0.01 | | 0.13 | 0.27 |
| n- C17 | 0.01 | | 0.06 | 0.17 |
| iso- C18 | | | 0.04 | 0.17 |
| n- C18 | | | 0.01 | 0.07 |
| C18+ | | | 0.03 | 0.09 |
| Total | 44.57 | 45.26 | 48.73 | 47.53 |
| total n-paraffins | 27.46 | 20.91 | 22.63 | 21.24 |
| total iso-paraffins | 17.11 | 24.35 | 26.07 | 26.20 |
| i/n | 0.62 | 1.16 | 1.15 | 1.23 |
| Isomerization ratio | 0.38 | 0.54 | 0.53 | 0.55 |
| Total normal C9-C12 | 20.66 | 17.23 | 15.84 | 14.44 |
| paraffins <C9 | 2.36 | 2.08 | 1.56 | 1.66 |
| paraffins >C12 | 8.70 | 7.92 | 14.37 | 15.20 |

TABLE 2

Physical properties and composition of renewable components

| | 410-304 F | 410-310 G | 410-311 H | 410-346 I | 410-367 J |
|---|---|---|---|---|---|
| Freezing point (° C.) ASTM D2386-19 | −46.0 | −33.0 | −41.0 | −46.0 | −54.0 |
| Freezing point (° C.) ASTM D7153-15e1 | | −34.4 | −40.2 | −42.1 | −52.4 |
| Density at 15° C. (Kg/m$^3$) ASTM D1298-12b(2017) | 755.6 | 762.3 | 767.7 | 760.7 | 750.7 |
| Composition (wt %) | | | | | |
| iso- C8 | 3.8 | 0.3 | | 0.4 | 0.2 |
| n- C8 | 3.3 | 0.5 | 0.1 | 0.7 | 1.2 |
| iso- C9 | 15.3 | 9.4 | 5.2 | 8.8 | 16.2 |
| n- C9 | 2.9 | 2.1 | 1.6 | 2.2 | 3.5 |
| iso- C10 | 13.9 | 11.1 | 8.2 | 10.6 | 17.1 |
| n- C10 | 2 | 1.6 | 1.3 | 1.9 | 2.4 |
| iso- C11 | 12 | 10.5 | 8.6 | 11.0 | 15.1 |
| n- C11 | 1.4 | 1.2 | 1.1 | 1.5 | 1.7 |
| iso- C12 | 10.9 | 10.5 | 8.5 | 10.3 | 12.6 |
| n- C12 | 1.1 | 1.0 | 0.9 | 1.3 | 1.2 |
| iso- C13 | 9.7 | 10.2 | 6.7 | 7.1 | 9.7 |
| n- C13 | 0.6 | 0.7 | 0.5 | 0.5 | 0.5 |
| iso- C14 | 5.7 | 6.5 | 5.9 | 5.4 | 5.0 |
| n- C14 | 0.3 | 0.4 | 0.5 | 0.5 | 0.3 |
| iso- C15 | 2.2 | 3.0 | 14.9 | 12.7 | 2.3 |

TABLE 2-continued

Physical properties and composition of renewable components

| | 410-304 F | 410-310 G | 410-311 H | 410-346 I | 410-367 J |
|---|---|---|---|---|---|
| n- C15 | 0.2 | 0.3 | 1.2 | 0.9 | 0.2 |
| iso- C16 | 3.6 | 6.4 | 15.8 | 12.8 | 2.7 |
| n- C16 | 0.5 | 0.9 | 1.7 | 1.4 | 0.3 |
| iso- C17 | 7.3 | 15.6 | 11.9 | 6.5 | 4.3 |
| n- C17 | 0.5 | 1.1 | 0.7 | 0.4 | 0.3 |
| iso- C18 | 2.4 | 5.9 | 4.3 | 2.5 | 1.5 |
| n- C18 | 0.2 | 0.5 | 0.3 | 0.2 | 0.1 |
| C18+ | 0.1 | 0.3 | | 0.1 | 0.1 |
| Total | 99.9 | 99.7 | 99.9 | 99.7 | 98.6 |
| total n-paraffins | 13 | 10.3 | 9.9 | 11.5 | 11.8 |
| total iso-paraffins | 86.8 | 89.4 | 90 | 88.1 | 86.7 |
| i/n | 6.7 | 8.7 | 9.9 | 7.7 | 7.4 |
| Isomerization ratio | 0.87 | 0.89 | 0.90 | 0.88 | 0.88 |
| Total normal C9-C12 | 7.4 | 5.9 | 4.9 | 6.9 | 8.8 |
| Total C9-C12 | 59.5 | 53.6 | 35.4 | 47.6 | 69.8 |
| Total C16 | 4.1 | 3.0 | 17.5 | 14.2 | 3.0 |
| Total C17 | 7.8 | 4.6 | 12.6 | 6.9 | 4.6 |
| iso-C16/iso-C17 | 0.5 | 0.4 | 1.3 | 2.0 | 0.6 |
| n-C16/n-C17 | 1.0 | 0.8 | 2.4 | 3.5 | 1.0 |
| C16/C17 | 0.5 | 0.4 | 1.4 | 2.1 | 0.7 |

TABLE 3 freezing points of jet fuel compositions according to the invention.

| Petroleum jet component | Renewable component | Content of Renewable component Vol % | Freezing point ASTM D2386-19 ° C. | Freezing point calculated from linear relation ASTM D2386-19 ° C. | Freezing point ASTM D7153-15e1 ° C. | Freezing point calculated from linear relation ASTM D7153-15e1 ° C. |
|---|---|---|---|---|---|---|
| Sample A (408-6643) | H (410-311) | 10 | −55.5 | −52.3 | −53.6 | −52.2 |
| | | 20 | −56 | −51.0 | −53.9 | −50.8 |
| | | 30 | −55 | −49.8 | −53.1 | −49.5 |
| | | 40 | −51.5 | −48.5 | −51.2 | −48.2 |
| | | 50 | −50.5 | −47.3 | −49.2 | −46.9 |
| | | 100 | −41 | −41.0 | −40.2 | −40.2 |
| Sample A (408-6643) | I (410-346) | 20 | −54 | −52.0 | −54.5 | −51.2 |
| | | 30 | −53.5 | −51.3 | −54.5 | −50.1 |
| | | 40 | −52.5 | −50.5 | −53.5 | −48.9 |
| | | 100 | −46 | −46.0 | −42.1 | −42.1 |
| Sample A (408-6643) | F (410-304) | 10 | −55.5 | −52.8 | | |
| | | 20 | −56.5 | −52.0 | | |
| | | 100 | −46 | −46.0 | | |
| Sample B (408-6628) | F (410-304) | 0 | −59.0 | −59.0 | −59.8 | −59.8 |
| | | 10 | −62 | −57.7 | | |
| | | 20 | −64 | −56.4 | | |
| | | 100 | −46 | | | |
| Sample B (408-6628) | J (410-367) | 10 | −60.5 | −58.5 | −60.8 | −59.1 |
| | | 20 | −62.0 | −58 | −62.3 | −58.3 |
| | | 30 | −63.0 | −57.5 | −63.7 | −57.6 |
| | | 100 | −54.0 | | −52.4 | −59.1 |
| Sample B (408-6628) | I (410-346) | 10 | −61.5 | −57.7 | −60.8 | −58.0 |
| | | 20 | −62.5 | −56.4 | −62.1 | −56.3 |
| | | 30 | −59.5 | −55.1 | −60.5 | −54.5 |
| | | 100 | −46 | | −42.1 | −42.1 |

All the jet fuel compositions comprising the petroleum jet component A show significantly improved cold properties with respect to the calculated freezing point, as also shown for some renewable component on FIG. 1. By "significantly improved" we mean that the difference between the measured freezing point and the calculated freezing point is equal or higher than the reproducibility of the freezing point measurement method.

From FIG. 1, we can expect an improvement of cold properties with respect to the linear calculations, with incorporation of 1 to 50 vol % of renewable jet component. Similar or better cold properties as the petroleum jet fuel component will be obtained.

The results show that improvement of cold properties is obtained even with renewable component having a high freezing point (−33° C.). For some renewable jet components, the freezing point of the jet fuel composition is better than the freezing point of the petroleum jet component, or similar, but always within the specifications of jet fuels.

Figure 2:
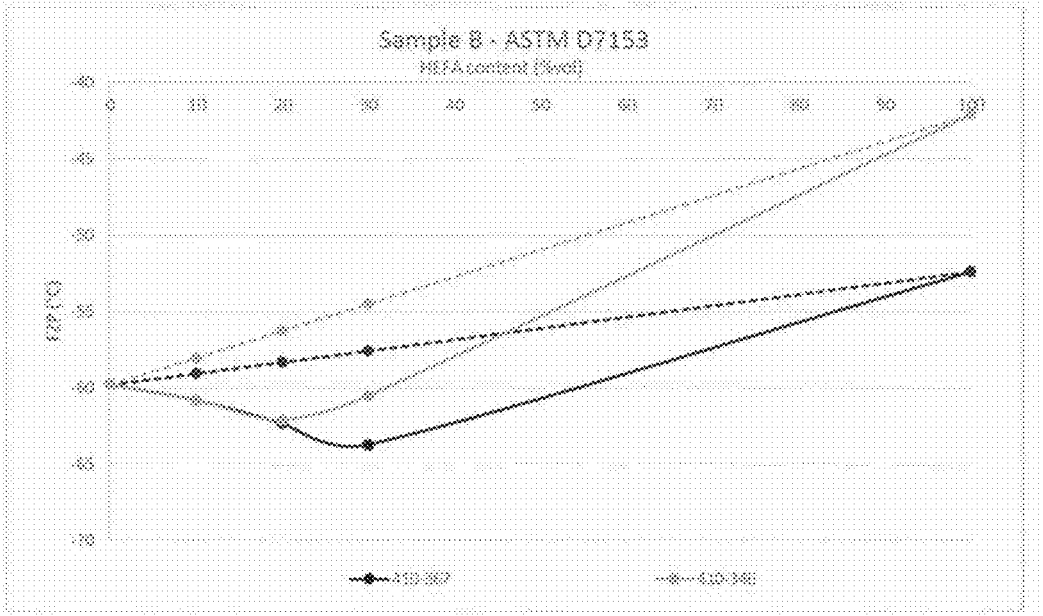
FIG. 2 is a graph comparing the measured freezing points and linear calculation of the freezing point (proportional to the volume content of the renewable jet component) for mixtures of a petroleum jet component according to the invention and several renewable jet components at different compositions. The measured freezing point is according to ASTM D7153-15e1.

Similar results are obtained with jet fuel compositions comprising the petroleum jet component B, as more clearly seen on FIG. 2.

Without wishing to be bound by a theory, the observed improvements may be due to the content of nC9-C12 of the jet fuel component.

TABLE 4 freezing points of mixtures of several comparative compositions made from mixtures of jets with renewable components

| Petroleum jet component | Renewable component | Content of Renewable component Vol % | Freezing point ASTM D2386-19 ° C. | Freezing point calculated from linear relation ASTM D2386-19 ° C. | Freezing point ASTM D7153-15e1 ° C. | Freezing point calculated from linear relation ASTM D7153-15e1 ° C. |
|---|---|---|---|---|---|---|
| Sample C (408-6618) | I (410-346) | 0 | −51.5 | −51.5 | −50.6 | −50.6 |
| | | 10 | −50.5 | −51.0 | −50.9 | −49.8 |
| | | 20 | −50.5 | −50.4 | −50.9 | −48.9 |
| | | 30 | −50.5 | −49.9 | −50.7 | −48.1 |
| | | 100 | −46.0 | −46.0 | −42.1 | −42.1 |
| Sample C (408-6618) | J (410-367) | 10 | −51.5 | −51.8 | −51.6 | −50.8 |
| | | 20 | −52.5 | −52.0 | −52.8 | −51.0 |
| | | 30 | −54.0 | −52.3 | −54.1 | −51.1 |
| | | 100 | −54.0 | −54.0 | −52.4 | −52.4 |
| Sample D (408-6657) | J (410-367) | 0 | −50.0 | −50.0 | −50.4 | −50.4 |
| | | 10 | −50.5 | −50.4 | −51.3 | −50.6 |
| | | 20 | −50.5 | −50.8 | −52.0 | −51.1 |
| | | 100 | −54 | −54.0 | −52.4 | −52.4 |
| Sample D (408-6657) | I (410-346) | 10 | −49.5 | −49.6 | −50.2 | −49.6 |
| | | 20 | −49.0 | −49.2 | −49.7 | −48.7 |
| | | 100 | −46.0 | −46.0 | −42.1 | −42.1 |
| Sample D (408-6657) | H (410-311) | 10 | −49.0 | −49.1 | −49.7 | −49.4 |
| | | 20 | −48.0 | −48.2 | −48.7 | −48.4 |
| | | 30 | −46.5 | −47.3 | −47.5 | −47.3 |
| | | 100 | −41.0 | −41.0 | −40.2 | −40.2 |

Figure 3:
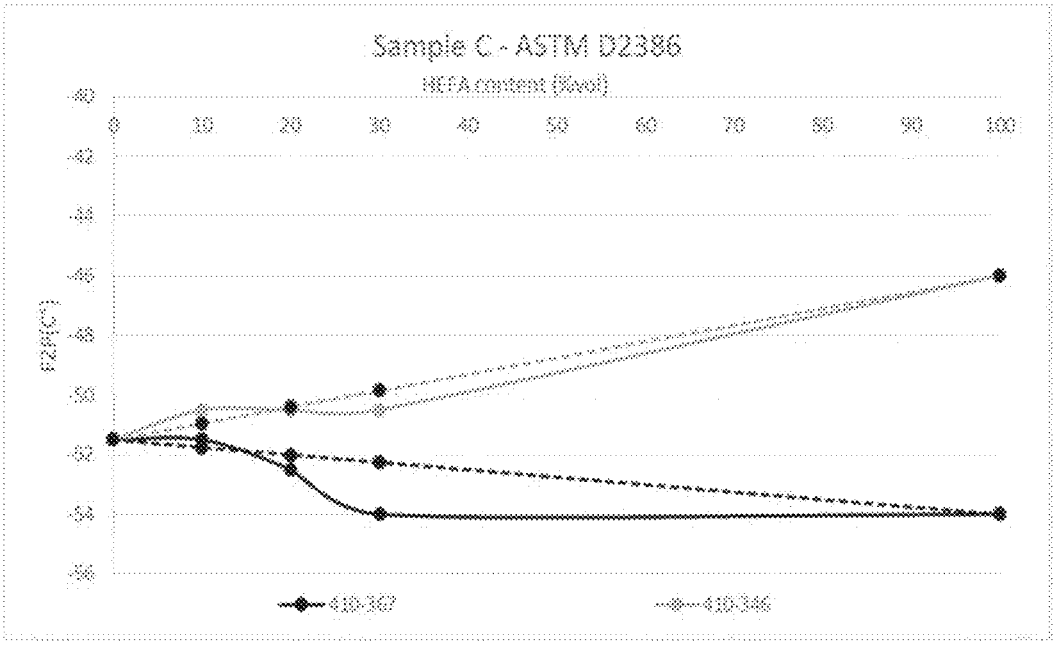
FIG. 3 is a graph comparing the measured freezing points and linear calculation of the freezing point (proportional to the volume content of the renewable jet component) for mixtures of a comparative petroleum jet component and several renewable jet components at different compositions. The measured freezing point is according to ASTM D2386-19.

Jet fuel compositions comprising a petroleum jet component which do not have from 17 wt % to 30 wt % of n-C9-C12 all have a freezing point which is not significantly better than that the freezing point calculated from the linear relation. By "not significantly better" we mean that the difference between the measured freezing point and the calculated freezing point is less than the reproducibility of the freezing point measurement method. This can be clearly seen on the graphs of FIG. 3, which shows the measured (with ASTM D2386-19) and calculated freezing point of compositions comprising jet component C.

Only the fuel compositions including a renewable component with a very low freezing point (−54° C.) have a freezing point below the one of the petroleum jet component, but always not significantly better than the calculated freezing point.

These results show that the cold properties of jet fuel composition comprising such petroleum jet component are not significantly improved despite the high iso-paraffins content of the renewable component.

TABLE 5

Properties of some of the above jet fuel compositions

| Petroleum jet component | Renewable component | Vol % of Renewable component | Density (kg/m3) ASTM D1298-12b(2017) |
|---|---|---|---|
| Sample A (408-6643) | | | 789.4 |
| | H (410-311) | 10 | 787.1 |
| | | 20 | 784.8 |
| | | 30 | 782.5 |
| | | 40 | 780.2 |
| | | 50 | 778.0 |
| | I (410-346) | 20 | 783.7 |
| | | 30 | 780.8 |
| | | 40 | 777.9 |
| Sample B (408-6628) | | | 797.6 |
| | F (410-304) | 10 | 793.4 |
| | | 20 | 789.2 |

TABLE 5-continued

Properties of some of the above jet fuel compositions

| Petroleum jet component | Renewable component | Vol % of Renewable component | Density (kg/m3) ASTM D1298-12b(2017) |
|---|---|---|---|
| | I (410-346) | 10 | 793.9 |
| | | 20 | 790.2 |
| | | 30 | 786.5 |

TABLE 6

| Compositions (in wt %) of a jet fuel composition comprising Sample A | | | | | |
|---|---|---|---|---|---|
| | Petroleum jet component Sample A (408-6643) Renewable component H (410-311) Vol % of Renewable component | | | | |
| | 10 | 20 | 30 | 40 | 50 |
| n-C6 | 0.02 | 0.02 | 0.01 | 0.01 | 0.01 |
| Iso-C7 | 0.06 | 0.06 | 0.05 | 0.04 | 0.04 |
| n-C7 | 0.26 | 0.23 | 0.20 | 0.17 | 0.15 |
| iso-C8 | 0.95 | 0.84 | 0.74 | 0.63 | 0.53 |
| n-C8 | 0.85 | 0.76 | 0.68 | 0.60 | 0.52 |
| iso-C9 | 2.31 | 2.07 | 1.82 | 1.58 | 1.33 |
| n-C9 | 4.17 | 3.72 | 3.26 | 2.81 | 2.36 |
| iso-C10 | 4.05 | 3.61 | 3.17 | 2.73 | 2.30 |
| n-C10 | 5.34 | 4.76 | 4.17 | 3.59 | 3.01 |
| iso-C11 | 2.76 | 2.46 | 2.17 | 1.87 | 1.58 |
| n-C11 | 5.29 | 4.72 | 4.14 | 3.56 | 2.99 |
| iso-C12 | 2.49 | 2.22 | 1.96 | 1.69 | 1.43 |
| n-C12 | 3.84 | 3.42 | 3.01 | 2.59 | 2.18 |
| iso-C13 | 1.64 | 1.47 | 1.30 | 1.13 | 0.96 |
| n-C13 | 2.88 | 2.57 | 2.26 | 1.95 | 1.65 |
| iso-C14 | 0.71 | 0.64 | 0.58 | 0.51 | 0.44 |
| n-C14 | 1.57 | 1.40 | 1.24 | 1.08 | 0.92 |
| iso-C15 | 1.79 | 3.24 | 4.70 | 6.16 | 7.62 |
| n-C15 | 0.58 | 0.65 | 0.72 | 0.79 | 0.86 |
| iso-C16 | 1.77 | 3.33 | 4.89 | 6.45 | 8.01 |
| n-C16 | 0.28 | 0.44 | 0.59 | 0.75 | 0.91 |
| iso-C17 | 1.20 | 2.39 | 3.58 | 4.77 | 5.96 |
| n-C17 | 0.08 | 0.15 | 0.22 | 0.29 | 0.36 |
| iso-C18 | 0.43 | 0.86 | 1.29 | 1.72 | 2.15 |
| n-C18 | 0.03 | 0.06 | 0.09 | 0.12 | 0.15 |
| C18+ | 0.00 | 0.00 | 0.00 | 0.00 | 0.00 |
| Total | 45.32 | 46.08 | 46.83 | 47.58 | 48.34 |
| total n-paraffins | 25.17 | 22.89 | 20.60 | 18.32 | 16.03 |
| total iso-paraffins | 20.15 | 23.19 | 26.23 | 29.27 | 32.31 |
| i/n | 0.80 | 1.01 | 1.27 | 1.60 | 2.02 |
| Total normal C9-C12 | 18.63 | 16.61 | 14.58 | 12.56 | 10.53 |
| Total C9-C12 | 30.24 | 26.97 | 23.70 | 20.43 | 17.16 |
| Total normal C9-C13 | 21.52 | 19.18 | 16.85 | 14.51 | 12.18 |
| Total C9-C13 | 34.76 | 31.01 | 27.26 | 23.51 | 19.76 |

TABLE 7

| Compositions (in wt %) of jet fuel compositions comprising Sample A and Sample B | | | | | | |
|---|---|---|---|---|---|---|
| | Petroleum jet component | | | | | |
| | Sample A (408-6643) Renewable component | | | Sample B (408-6628) Renewable component | | |
| | I (410-346) | | | I (410-346) | | |
| | Vol % of Renewable component | | | | | |
| | 20 | 30 | 40 | 10 | 20 | 30 |
| n-C6 | 0.02 | 0.01 | 0.01 | 0.01 | 0.01 | 0.01 |
| Iso-C7 | 0.06 | 0.05 | 0.04 | 0.22 | 0.19 | 0.17 |
| n-C7 | 0.23 | 0.20 | 0.17 | 0.25 | 0.22 | 0.20 |
| iso- C8 | 0.92 | 0.86 | 0.79 | 0.66 | 0.63 | 0.60 |
| n- C8 | 0.88 | 0.86 | 0.84 | 0.84 | 0.83 | 0.81 |
| iso- C9 | 3.81 | 4.43 | 5.06 | 2.33 | 3.05 | 3.77 |
| n- C9 | 4.14 | 3.89 | 3.65 | 1.97 | 1.99 | 2.02 |
| iso- C10 | 5.71 | 6.32 | 6.93 | 5.39 | 5.97 | 6.55 |
| n- C10 | 5.12 | 4.71 | 4.31 | 4.41 | 4.13 | 3.85 |
| iso- C11 | 4.64 | 5.44 | 6.23 | 7.05 | 7.49 | 7.93 |
| n- C11 | 5.00 | 4.56 | 4.12 | 5.71 | 5.24 | 4.78 |
| iso- C12 | 4.26 | 5.02 | 5.77 | 5.53 | 6.06 | 6.59 |
| n- C12 | 3.66 | 3.37 | 3.07 | 4.11 | 3.80 | 3.48 |
| iso- C13 | 2.87 | 3.40 | 3.93 | 3.77 | 4.14 | 4.51 |

TABLE 7-continued

| Compositions (in wt %) of jet fuel compositions comprising Sample A and Sample B | | | | | | |
|---|---|---|---|---|---|---|
| | Petroleum jet component | | | | | |
| | Sample A (408-6643) Renewable component | | | Sample B (408-6628) Renewable component | | |
| | I (410-346) | | | I (410-346) | | |
| | Vol % of Renewable component | | | | | |
| | 20 | 30 | 40 | 10 | 20 | 30 |
| n- C13 | 2.65 | 2.38 | 2.11 | 1.92 | 1.76 | 1.61 |
| iso- C14 | 1.70 | 2.17 | 2.63 | 2.03 | 2.41 | 2.78 |
| n- C14 | 1.48 | 1.36 | 1.24 | 0.41 | 0.42 | 0.43 |
| iso- C15 | 2.80 | 4.04 | 5.28 | 1.57 | 2.80 | 4.04 |
| n- C15 | 0.59 | 0.63 | 0.67 | 0.13 | 0.21 | 0.30 |
| iso- C16 | 2.73 | 3.99 | 5.25 | 1.28 | 2.56 | 3.84 |
| n- C16 | 0.38 | 0.50 | 0.63 | 0.15 | 0.29 | 0.43 |
| iso- C17 | 1.31 | 1.96 | 2.61 | 0.65 | 1.30 | 1.95 |
| n- C17 | 0.09 | 0.13 | 0.17 | 0.04 | 0.08 | 0.12 |
| iso- C18 | 0.50 | 0.75 | 1.00 | 0.25 | 0.50 | 0.75 |
| n- C18 | 0.04 | 0.06 | 0.08 | 0.02 | 0.04 | 0.06 |
| C18+ | 0.02 | 0.03 | 0.04 | 0.01 | 0.02 | 0.03 |
| Total | 55.60 | 61.11 | 66.62 | 50.70 | 56.15 | 61.59 |
| total n-paraffins | 24.27 | 22.67 | 21.08 | 19.97 | 19.03 | 18.09 |
| total iso-paraffins | 31.31 | 38.41 | 45.51 | 30.73 | 37.10 | 43.48 |
| i/n | 1.29 | 1.69 | 2.16 | 1.54 | 1.95 | 2.40 |
| Total normal C9-C12 | 17.91 | 16.53 | 15.16 | 16.20 | 15.16 | 14.13 |
| Total C9-C12 | 36.33 | 37.74 | 39.15 | 36.49 | 37.73 | 38.96 |
| Total normal C9-C13 | 20.56 | 18.92 | 17.27 | 18.12 | 16.93 | 15.74 |
| Total C9-C13 | 41.85 | 43.52 | 45.19 | 42.19 | 43.63 | 45.08 |

TABLE 8

| Compositions (in wt %) of jet fuel composition comprising Sample D | | | |
|---|---|---|---|
| | Petroleum jet component Sample D (408-6657) Renewable component H (410-311) Vol % of Renewable component | | |
| | 10 | 20 | 30 |
| n-C6 | 0.009 | 0.008 | 0.007 |
| Iso-C7 | 0.117 | 0.104 | 0.091 |
| n-C7 | 0.189 | 0.168 | 0.147 |
| iso-C8 | 0.513 | 0.456 | 0.399 |
| n-C8 | 0.676 | 0.612 | 0.548 |
| iso-C9 | 1.945 | 1.74 | 1.535 |
| n-C9 | 2.584 | 2.308 | 2.032 |
| iso-C10 | 5.095 | 4.54 | 3.985 |
| n-C10 | 4.042 | 3.604 | 3.166 |
| iso-C11 | 3.952 | 3.524 | 3.096 |
| n-C11 | 3.43 | 3.06 | 2.69 |
| iso-C12 | 3.655 | 3.26 | 2.865 |
| n-C12 | 2.98 | 2.66 | 2.34 |
| iso-C13 | 2.863 | 2.556 | 2.249 |
| n-C13 | 2.215 | 1.98 | 1.745 |
| iso-C14 | 2.44 | 2.18 | 1.92 |
| n-C14 | 1.567 | 1.404 | 1.241 |
| iso-C15 | 3.596 | 4.852 | 6.108 |
| n-C15 | 0.993 | 1.016 | 1.039 |
| iso-C16 | 2.138 | 3.656 | 5.174 |
| n-C16 | 0.575 | 0.7 | 0.825 |
| iso-C17 | 1.433 | 2.596 | 3.759 |

TABLE 8-continued

| Compositions (in wt %) of jet fuel composition comprising Sample D | | | |
|---|---|---|---|
| | Petroleum jet component Sample D (408-6657) Renewable component H (410-311) Vol % of Renewable component | | |
| | 10 | 20 | 30 |
| n-C17 | 0.223 | 0.276 | 0.329 |
| iso-C18 | 0.583 | 0.996 | 1.409 |
| n-C18 | 0.093 | 0.116 | 0.139 |
| C18+ | 0.081 | 0.072 | 0.063 |
| Total | 47.99 | 48.44 | 48.90 |
| total n-paraffins | 19.58 | 17.91 | 16.25 |
| total iso-paraffins | 28.33 | 30.46 | 32.59 |
| i/n | 1.45 | 1.70 | 2.01 |
| Total normal C9-C12 | 13.036 | 11.632 | 10.228 |
| Total C9-C12 | 27.683 | 24.696 | 21.709 |
| Total normal C9-C13 | 15.251 | 13.612 | 11.973 |
| Total C9-C13 | 32.761 | 29.232 | 25.703 |

The invention claimed is:

1. Jet fuel composition comprising a petroleum derived jet fuel component and a renewable component comprising hydroprocessed esters and fatty acids, wherein the jet fuel composition contains 1 to 50 vol % of the renewable component and has a freezing point of −40° C. or below, and the petroleum derived jet fuel component has a content of C9-C12 normal paraffins from 17 wt % to 30 wt % and wherein the freezing point of the jet fuel composition is lower than a theoretical freezing point calculated from a linear relation, the theoretical freezing point being obtained by pondering the freezing point of each compound by its content and addition of the results.

2. Jet fuel composition according to claim 1, wherein the petroleum derived jet fuel component has a total content of paraffins from 40 to 55 wt %.

3. Jet fuel composition according to claim 1, wherein the petroleum derived jet fuel component has a freezing point of −40° C. or below.

4. Jet fuel composition according to claim 1, wherein the renewable component has one or more of the following features:

an isoparaffin content of 80 wt % or more, an iso-paraffins to normal paraffins ratio of at least 6.5:1, a C9-C17 paraffins content of at least 80 wt %, a C9-C17 iso-paraffins content of at least 75 wt %, a content of paraffins lower than C15 from 45 wt % to 90 wt %.

5. Jet fuel composition according to claim 1, wherein the renewable component has one or more of the following features:

a freezing point below-30° C., a density at 15° C. between 730 and 772 kg/m$^3$.

6. Jet fuel composition according to claim 1, wherein the renewable component is produced from one or more oils chosen among vegetable oil, animal fat, preferentially inedible highly saturated oils, waste oils, by-products of the refining of vegetable oil(s) or of animal oil(s) containing free fatty acids, tall oils, and oil produced by bacteria, yeast, algae, prokaryotes or eukaryotes.

7. Jet fuel composition according to claim 1, wherein the jet fuel composition has a normal paraffins content of C9-C12 paraffins from 10 to 20 wt % and a total normal paraffins content from 15 to 30 wt %.

8. Method for producing a jet fuel composition, wherein the method comprises mixing a petroleum derived jet fuel component and a renewable component comprising hydroprocessed esters and fatty acids to obtain a jet fuel composition containing 1 to 50 vol % of the renewable component and having a freezing point of −40° C. or below, wherein the petroleum derived jet fuel component has a content of C9-C12 normal paraffins from 17 wt % to 30 wt % and wherein the freezing point of the jet fuel composition is lower than a theoretical freezing point calculated from a linear relation, the theoretical freezing point being obtained by pondering the freezing point of each compound by its content and addition of the results.

9. The method as claimed in claim 8, wherein the petroleum derived jet fuel component has a total content of paraffins from 40 to 55 wt %.

10. The method as claimed in claim 8, wherein the renewable jet fuel component has one or more of the following features:

an isoparaffin content of 80 wt % or more, an iso-paraffins to normal paraffins ratio of at least 6.5:1, a C9-C17 paraffins content of at least 80 wt %, a C9-C17 iso-paraffins content of at least 75 wt %, a content of paraffins lower than C15 from 45 wt % to 90 wt %, a C9-C12 n-paraffins content of less than 20 wt %.

11. The method as claimed in claim 8, wherein the renewable component has one or more of the following features:

a freezing point below −30° C., a density at 15° C. between 730 and 772 kg/m$^3$.

12. The method as claimed in claim 8, wherein renewable component is produced from one or more oils chosen among vegetable oil, animal fat, preferentially inedible highly saturated oils, waste oils, by-products of the refining of vegetable oil(s) or of animal oil(s) containing free fatty acids, tall oils, and oil produced by bacteria, yeast, algae, prokaryotes or eukaryotes.

13. The method as claimed in claim 8, wherein the jet fuel composition has a normal paraffins content of C9-C12 paraffins from 10 to 20 wt % and a total normal paraffins content from 15 to 30 wt %.

14. A method for obtaining a jet fuel composition from a mixture of a petroleum derived jet fuel component and a renewable component comprising hydroprocessed esters and fatty acids, such jet fuel composition having a freezing point of −40° C. or below, and said freezing point being lower than a theoretical freezing point calculated from a linear relation, wherein the renewable component is mixed in a content from 1 to 50 vol % with a petroleum derived jet fuel component having a content of C9-C12 normal paraffins from 17 wt % to 30 wt %, the theoretical freezing point being obtained by pondering the freezing point of each compound by its content and addition of the results.

15. Jet fuel composition according to claim 1, wherein the difference between the measured freezing point and the calculated freezing point is equal to or higher than the reproducibility of the freezing point measurement method according to ASTM D2386-19.

16. The method as claimed in claim 8, wherein the difference between the measured freezing point and the calculated freezing point is equal to or higher than the reproducibility of the freezing point measurement method according to ASTM D2386-19.

17. The method as claimed in claim 14, wherein the difference between the measured freezing point and the calculated freezing point is equal to or higher than the reproducibility of the freezing point measurement method according to ASTM D2386-19.

* * * * *